US009879895B2

(12) United States Patent
Wait et al.

(10) Patent No.: US 9,879,895 B2
(45) Date of Patent: Jan. 30, 2018

(54) ICE MAKER ASSEMBLY FOR A REFRIGERATOR APPLIANCE AND A METHOD FOR OPERATING THE SAME

(71) Applicant: General Electric Company, Schenectady, NY (US)

(72) Inventors: Keith Wesley Wait, Louisville, KY (US); Alan Joseph Mitchell, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 755 days.

(21) Appl. No.: 14/049,507

(22) Filed: Oct. 9, 2013

(65) Prior Publication Data

US 2015/0096310 A1 Apr. 9, 2015

(51) Int. Cl.
*F25C 5/08* (2006.01)
*F25C 1/14* (2006.01)

(52) U.S. Cl.
CPC ..... *F25C 1/147* (2013.01); *F25C 2400/10* (2013.01); *F25C 2600/04* (2013.01); *F25C 2700/12* (2013.01); *F25C 2700/14* (2013.01)

(58) Field of Classification Search
CPC .. F25C 1/147; F25C 2700/12; F25C 2600/04; F25C 2400/10
See application file for complete search history.

(56) References Cited

U.S. PATENT DOCUMENTS 3,346,726 A * 10/1967 Rouxel ..... G05B 13/02 318/561
4,383,770 A * 5/1983 Boschung ..... G01N 25/04 374/25
4,424,683 A 1/1984 Manson
4,601,587 A * 7/1986 Mathiprakasam ..... G01N 25/04 374/16
4,622,826 A 11/1986 Tsukiyama et al.
5,141,329 A * 8/1992 Orlando ..... G01N 25/04 374/16
5,187,948 A * 2/1993 Frohbieter ..... F25C 1/08 62/351
6,351,955 B1 * 3/2002 Oltman ..... F25C 1/04 62/353
6,526,763 B2 * 3/2003 Tchougounov ..... F25C 1/04 62/135
6,948,329 B2 9/2005 Nomura et al.
7,062,925 B2 6/2006 Tsuchikawa et al.
7,131,280 B2 11/2006 Voglewede et al.
7,185,508 B2 3/2007 Voglewede et al.
7,547,137 B2 * 6/2009 Nakamura ..... G01N 25/20 374/1

(Continued)

*Primary Examiner* — Kun Kai Ma
(74) *Attorney, Agent, or Firm* — Dority & Manning, P.A.

(57) ABSTRACT

An ice maker assembly and a method for operating an ice maker are provided. The method includes measuring a temperature of the ice maker and determining a first derivative of the temperature of the ice maker with respect to time. An operating state of the ice maker is established based at least in part on the temperature of the ice maker and the first derivative of the temperature of the ice maker with respect to time. Knowledge of the operating state of the ice maker can assist with preventing damage to a motor of the ice maker and with detecting super-cooled liquid water in a mold body of the ice maker.

12 Claims, 9 Drawing Sheets

(56) References Cited

U.S. PATENT DOCUMENTS

| | | | | |
|---|---|---|---|---|
| 8,322,148 | B2 | 12/2012 | Kim et al. | |
| 2004/0204920 | A1* | 10/2004 | Zimmermann | G01F 1/696 702/189 |
| 2005/0016990 | A1* | 1/2005 | Wilkins | H05B 3/746 219/494 |
| 2007/0039335 | A1* | 2/2007 | Kwon | F25C 1/04 62/138 |
| 2009/0223230 | A1* | 9/2009 | Kim | F25C 1/08 62/73 |
| 2010/0139299 | A1* | 6/2010 | Lee | G01F 23/2921 62/137 |
| 2010/0287959 | A1 | 11/2010 | Kim et al. | |
| 2010/0319385 | A1* | 12/2010 | Hashimoto | F16H 25/16 62/344 |
| 2011/0100039 | A1* | 5/2011 | Kim | F25C 5/005 62/139 |
| 2011/0138821 | A1* | 6/2011 | Chase | F25C 5/007 62/71 |
| 2011/0277473 | A1* | 11/2011 | Courtright | F01K 3/00 60/643 |
| 2012/0047917 | A1* | 3/2012 | Rafalovich | F25D 11/025 62/66 |
| 2012/0279240 | A1* | 11/2012 | Jeong | F25C 1/04 62/129 |
| 2012/0285187 | A1* | 11/2012 | Sugaya | F25C 5/08 62/137 |
| 2012/0324918 | A1* | 12/2012 | Bortoletto | F25B 5/00 62/73 |
| 2013/0276472 | A1* | 10/2013 | Mitchell | F25C 1/147 62/344 |

* cited by examiner

ICE MAKER ASSEMBLY FOR A REFRIGERATOR APPLIANCE AND A METHOD FOR OPERATING THE SAME

FIELD OF THE INVENTION

The present subject matter relates generally to ice makers, such as nugget style ice makers, for refrigerator appliances and methods for operating the same.

BACKGROUND OF THE INVENTION

Certain refrigerator appliances include an ice maker. To produce ice, liquid water is directed to the ice maker and frozen. A variety of ice types can be produced depending upon the particular ice maker used. For example, certain ice makers include a mold body for receiving liquid water. An auger within the mold body can rotate and scrape ice off an inner surface of the mold body to form ice nuggets. Such ice makers are generally referred to as nugget style ice makers. Certain consumers prefer nugget style ice makers and their associated ice nuggets.

Nugget style ice makers can be operated to maximize an ice making rate of the ice maker. However, various conditions can negatively affect operation of nugget style ice makers. For example, ice within the mold body can jam the auger or otherwise prevent rotation of the auger within the mold body, and such jamming can damage a motor of the nugget style ice maker. To prevent or fix such jamming, a heater on the mold body can be activated to melt ice therein. However, activating the heater can prevent or hinder ice formation, and liquid water within the mold body that is in a super-cooled state can cause the heater to activate despite the auger continuing to operate properly.

Accordingly, a method for operating an ice maker that assists with preventing damage to a motor of the ice maker would be useful. Further, a method for operating an ice maker that assists with detecting super-cooled liquid water within a mold body of the ice maker would be useful.

BRIEF DESCRIPTION OF THE INVENTION

The present subject matter provides an ice maker assembly and a method for operating an ice maker. The method includes measuring a temperature of the ice maker and determining a first derivative of the temperature of the ice maker with respect to time. An operating state of the ice maker is established based at least in part on the temperature of the ice maker and the first derivative of the temperature of the ice maker with respect to time. Knowledge of the operating state of the ice maker can assist with preventing damage to a motor of the ice maker and with detecting super-cooled liquid water in a mold body of the ice maker. Additional aspects and advantages of the invention will be set forth in part in the following description, or may be apparent from the description, or may be learned through practice of the invention.

In a first exemplary embodiment, a method for operating an ice maker is provided. The method includes measuring a temperature of the ice maker, determining a first derivative of the temperature of the ice maker with respect to time, and establishing an operating state of the ice maker based at least in part on the temperature of the ice maker and the first derivative of the temperature of the ice maker with respect to time.

In a second exemplary embodiment, an ice maker assembly for a refrigerator appliance is provided. The ice maker assembly includes a casing and an auger rotatably mounted within the casing. A motor is mounted to the casing and is configured for selectively rotating the auger. A fan is configured for directing a flow of chilled air towards the casing. A heater is mounted to the casing and is configured for selectively heating the casing. A temperature sensor is configured for measuring a temperature of the casing. An ice bucket is configured for receiving ice from the casing. A controller is in operative communication with the motor, the fan, the heater and the temperature sensor. The controller is configured for measuring the temperature of the casing with the temperature sensor, determining a first derivative of the temperature of the casing with respect to time, and establishing an operating state of the ice maker assembly based at least in part on the temperature of the casing and the first derivative of the temperature of the casing with respect to time.

In a third exemplary embodiment, a method for operating an ice maker is provided. The method includes measuring a temperature of the ice maker and determining a first derivative of the temperature of the ice maker with respect to time. The method also includes a step for detecting super-cooled liquid within the ice maker based at least in part on the temperature of the ice maker and the first derivative of the temperature of the ice maker with respect to time.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
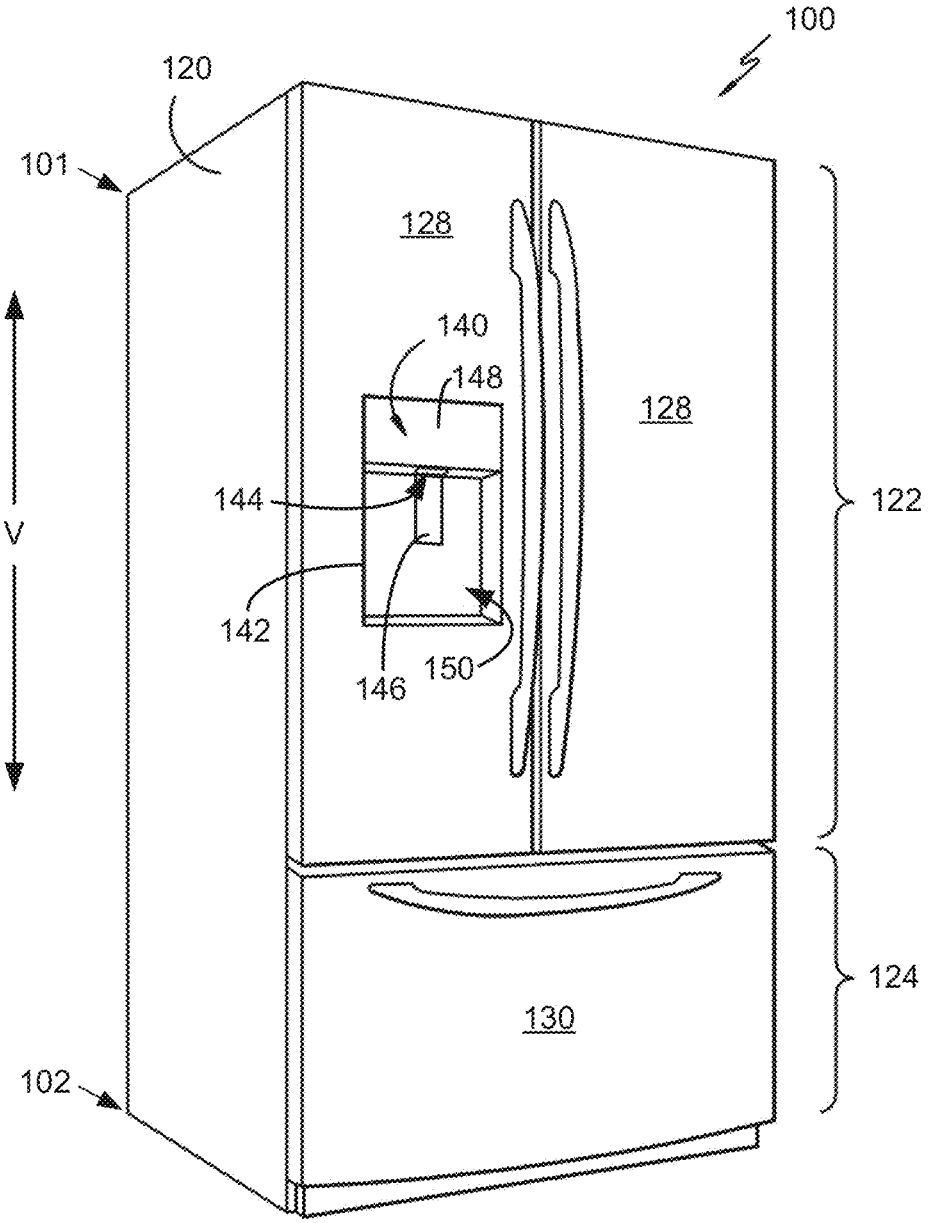
FIG. 1 provides a perspective view of a refrigerator appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

FIG. 1 provides a perspective view of a refrigerator appliance 100 according to an exemplary embodiment of the present subject matter. Refrigerator appliance 100 includes a cabinet or housing 120 that extends between a top 101 and a bottom 102 along a vertical direction V. Housing 120 defines chilled chambers for receipt of food items for storage. In particular, housing 120 defines fresh food chamber 122 positioned at or adjacent top 101 of housing 120 and a freezer chamber 124 arranged at or adjacent bottom 102 of housing 120. As such, refrigerator appliance 100 is generally referred to as a bottom mount refrigerator. It is recognized, however, that the benefits of the present disclosure apply to other types and styles of refrigerator appliances such as, e.g., a top mount refrigerator appliance or a side-by-side style refrigerator appliance. Consequently, the description set forth herein is for illustrative purposes only and is not intended to be limiting in any aspect to any particular refrigerator chamber configuration.

Refrigerator doors 128 are rotatably hinged to an edge of housing 120 for selectively accessing fresh food chamber 122. In addition, a freezer door 130 is arranged below refrigerator doors 128 for selectively accessing freezer chamber 124. Freezer door 130 is coupled to a freezer drawer (not shown) slidably mounted within freezer chamber 124. Refrigerator doors 128 and freezer door 130 are shown in the closed configuration in FIG. 1.

Refrigerator appliance 100 also includes a dispensing assembly 140 for dispensing liquid water and/or ice. Dispensing assembly 140 includes a dispenser 142 positioned on or mounted to an exterior portion of refrigerator appliance 100, e.g., on one of doors 120. Dispenser 142 includes a discharging outlet 144 for accessing ice and liquid water. An actuating mechanism 146, shown as a paddle, is mounted below discharging outlet 144 for operating dispenser 142. In alternative exemplary embodiments, any suitable actuating mechanism may be used to operate dispenser 142. For example, dispenser 142 can include a sensor (such as an ultrasonic sensor) or a button rather than the paddle. A user interface panel 148 is provided for controlling the mode of operation. For example, user interface panel 148 includes a plurality of user inputs (not labeled), such as a water dispensing button and an ice-dispensing button, for selecting a desired mode of operation such as crushed or non-crushed ice.

Discharging outlet 144 and actuating mechanism 146 are an external part of dispenser 142 and are mounted in a dispenser recess 150. Dispenser recess 150 is positioned at a predetermined elevation convenient for a user to access ice or water and enabling the user to access ice without the need to bend-over and without the need to open doors 120. In the exemplary embodiment, dispenser recess 150 is positioned at a level that approximates the chest level of a user.

Figure 2:
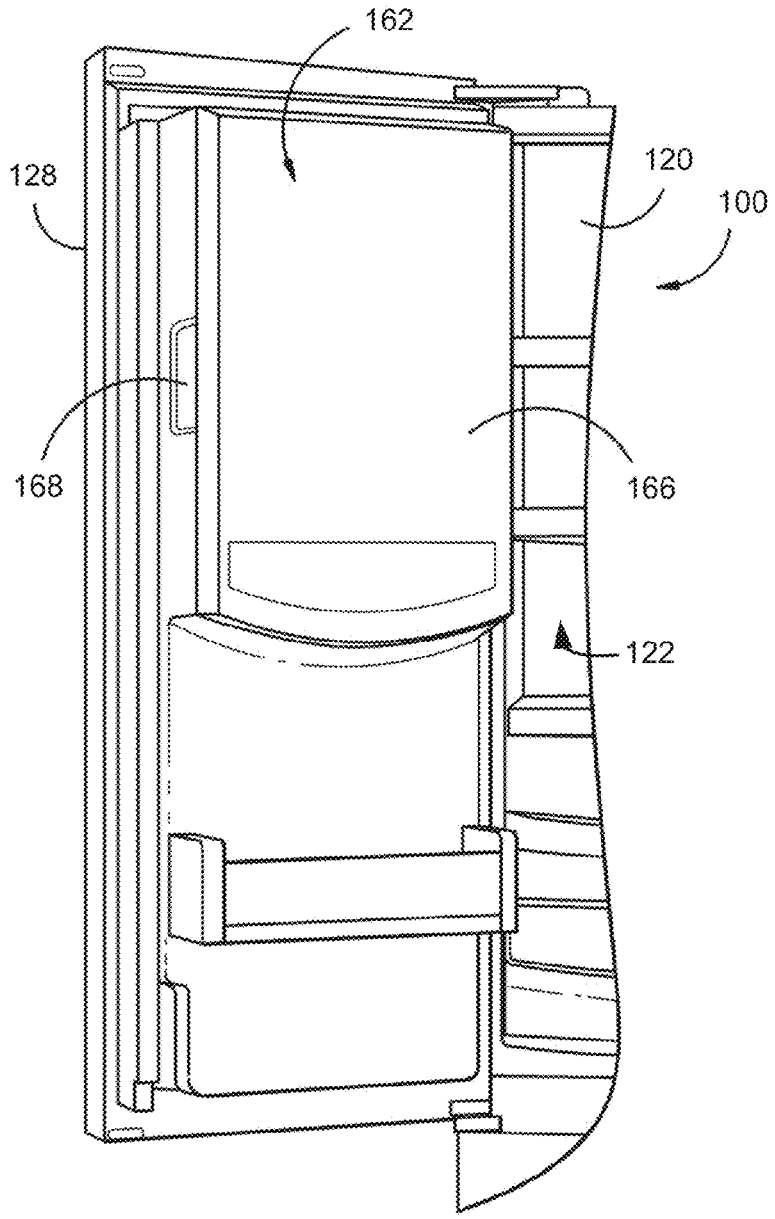
FIG. 2 provides a perspective view of a door of the exemplary refrigerator appliance of FIG. 1.

FIG. 2 provides a perspective view of a door of refrigerator doors 128. Refrigerator appliance 100 includes a freezer sub-compartment 162 defined on refrigerator door 128. Freezer sub-compartment 162 is often referred to as an "icebox." Freezer sub-compartment 162 extends into fresh food chamber 122 when refrigerator door 128 is in the closed position. As discussed in greater detail below, an ice maker or ice making assembly 160 and an ice storage bin 164 (FIG. 3) are positioned or disposed within freezer sub-compartment 162. Thus, ice is supplied to dispenser recess 150 (FIG. 1) from the ice making assembly 160 and/or ice storage bin 164 in freezer sub-compartment 162 on a back side of refrigerator door 128. Chilled air from a sealed system (not shown) of refrigerator appliance 100 may be directing into freezer sub-compartment 162 in order to cool ice making assembly 160 and/or ice storage bin 164 as discussed in greater detail below.

An access door 166 is hinged to refrigerator door 128. Access door 166 permits selective access to freezer sub-compartment 162. Any manner of suitable latch 168 is configured with freezer sub-compartment 162 to maintain access door 166 in a closed position. As an example, latch 168 may be actuated by a consumer in order to open access door 166 for providing access into freezer sub-compartment 162. Access door 166 can also assist with insulating freezer sub-compartment 162, e.g., by thermally isolating or insulating freezer sub-compartment 162 from fresh food chamber 122.

Figure 3:
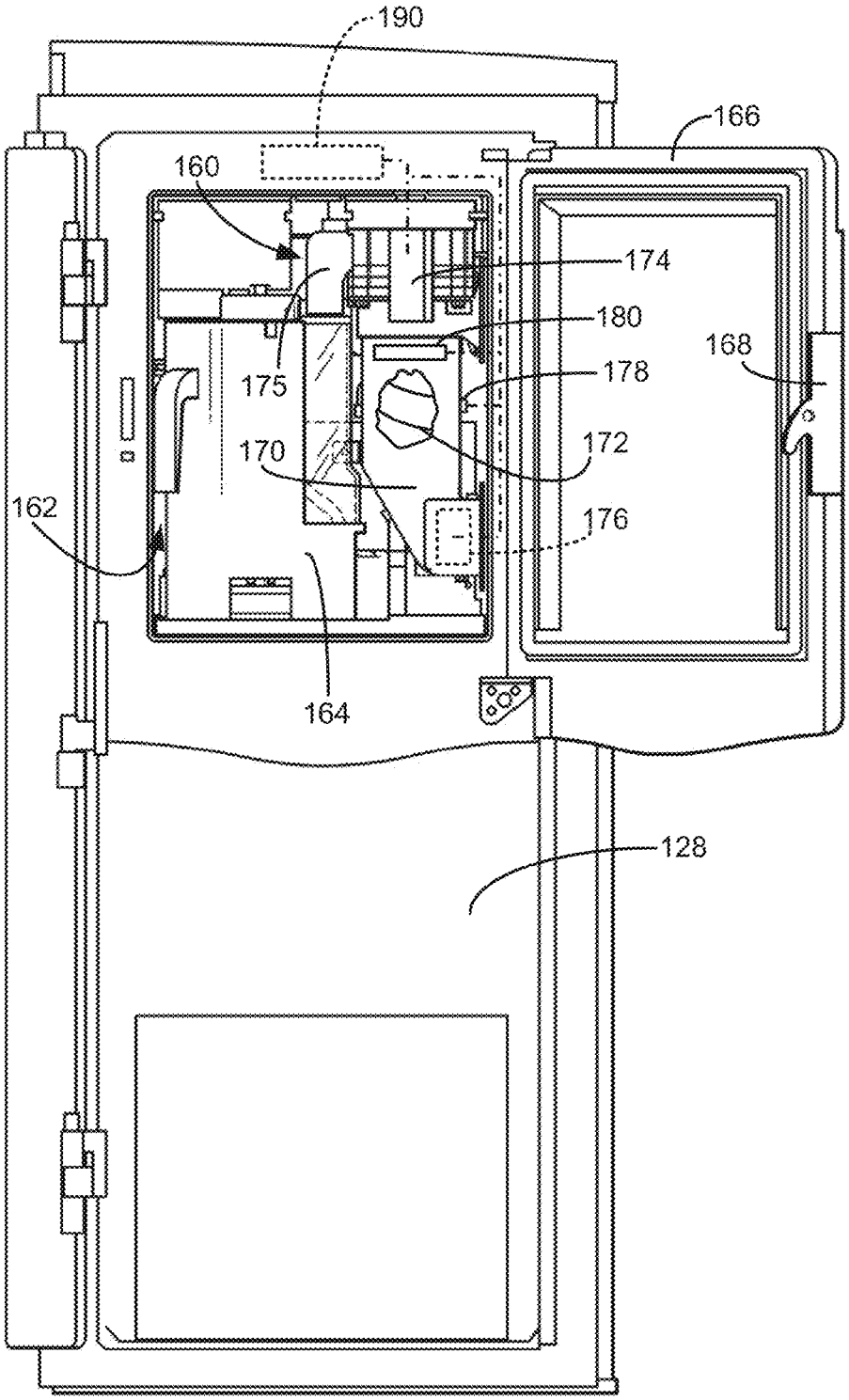
FIG. 3 provides an elevation view of the door of the exemplary refrigerator appliance of FIG. 2 with an access door of the door shown in an open position.

FIG. 3 provides an elevation view of refrigerator door 128 with access door 166 shown in an open position. As may be seen in FIG. 3, ice making assembly 160 is positioned or disposed within freezer sub-compartment 162. Ice making assembly 160 includes a mold body or casing 170. An auger 172 is rotatably mounted within casing 170 (shown partially cutout to reveal auger 172). In particular, a motor 174 is mounted to casing 170 and is in mechanical communication with (e.g., coupled to) auger 172. Motor 174 is configured for selectively rotating auger 172 within casing 170. During rotation of auger 172 within casing 170, auger 172 scrapes or removes ice off an inner surface of casing 170 and directs such ice to an extruder 175. At extruder 175, ice nuggets are formed from ice within casing 170. An ice bucket or ice storage bin 164 is positioned below extruder 175 and receives the ice nuggets from extruder 175. From ice storage bin 164, the ice nuggets can enter dispensing assembly 140 and be accessed by a user as discussed above. In such a manner, ice making assembly 160 can produce or generate ice nuggets.

Ice making assembly 160 also includes a fan 176. Fan 176 is configured for directing a flow of chilled air towards casing 170. As an example, fan 176 can direct chilled air from an evaporator of a sealed system through a duct to casing 170. Thus, casing 170 can be cooled with chilled air from fan 176 such that ice making assembly 160 is air cooled in order to form ice therein. Ice making assembly 160 also includes a heater 180, such as an electric resistance heating element, mounted to casing 170. Heater 180 is configured for selectively heating casing 170, e.g., when ice prevents or hinders rotation of auger 172 within casing 170, as discussed in greater detail below.

Operation of ice making assembly 160 is controlled by a processing device or controller 190, e.g., that may be operatively coupled to control panel 148 for user manipulation to select features and operations of ice making assembly 160. Controller 190 can operates various components of ice making assembly 160 to execute selected system cycles and features. For example, controller 190 is in operative communication with motor 174, fan 176 and heater 180. Thus, controller 190 can selectively activate and operate motor 174, fan 176 and heater 180.

Controller 190 may include a memory and microprocessor, such as a general or special purpose microprocessor operable to execute programming instructions or micro-control code associated with operation of ice making assembly 160. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 190 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Motor 174, fan 176 and heater 180 may be in communication with controller 190 via one or more signal lines or shared communication busses.

Ice making assembly 160 also includes a temperature sensor 178. Temperature sensor 178 is configured for measuring a temperature of casing 170 and/or liquids, such as liquid water, within casing 170. Temperature sensor 178 can be any suitable device for measuring the temperature of casing 170 and/or liquids therein. For example, temperature sensor 178 may be a thermistor or a thermocouple. Controller 190 can receive a signal, such as a voltage or a current, from temperature sensor 190 that corresponds to the temperature of the temperature of casing 170 and/or liquids therein. In such a manner, the temperature of casing 170 and/or liquids therein can be monitored and/or recorded with controller 190.

Figure 4:
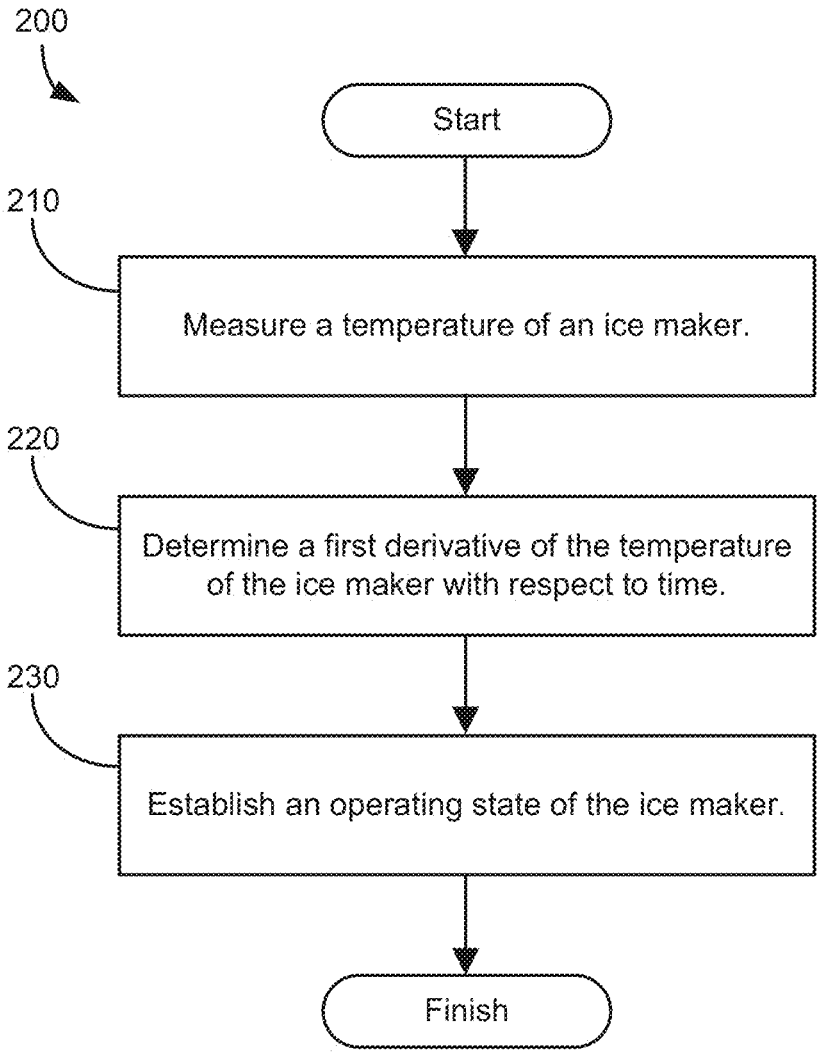
FIG. 4 illustrates a method for operating an ice maker according to an exemplary embodiment of the present subject matter.

FIG. 4 illustrates a method 200 for operating an ice maker according to an exemplary embodiment of the present subject matter. Method 200 can be used to operate any suitable ice maker. For example, method 200 may be used to operate ice making assembly 160 of refrigerator appliance 100 (FIG. 1). In particular, controller 190 of ice making assembly 160 may be programmed or configured to implement method 200. Utilizing method 200, damage to motor 174 of ice making assembly 160 can be limited or prevented. Further, method 200 can assist with detecting super-cooled liquid water in casing 170 of ice making assembly 160.

At step 210, a temperature of ice making assembly 160 is measured. As an example, controller 190 can measure the temperature of casing 170 with temperature sensor 178 at step 210. At step 220, a first derivative of the temperature of ice making assembly 160 with respect to time is determined. As an example, controller 190 can determine the first derivative of the temperature of casing 170 with respect to time at step 220. In particular, controller 190 can receive multiple temperature measurements from temperature sensor 178 and can determine the first derivative of the temperature of casing 170 with respect to time based at least in part on the multiple temperature measurements at step 220.

At step 230, an operating state of ice making assembly 160 is established or changed. For example, controller 190 can establish or change the operating state of ice making assembly 160 at step 230 based at least in part on the temperature of ice making assembly 160 measured at step 210 and the first derivative of the temperature of ice making assembly 160 with respect to time determined at step 220. Step 230 is discussed in greater detail below with reference to FIGS. 5 and 6.

Method 200 can also include ascertaining a second derivative of the temperature of ice making assembly 160 with respect to time. As an example, controller 190 can determine the second derivative of the temperature of casing 170 with respect to time. In particular, controller 190 can receive multiple temperature measurements from temperature sensor 178 and can determine the second derivative of the temperature of casing 170 with respect to time based at least in part on the multiple temperature measurements. Controller 190 can utilize the second derivative of the temperature of casing 170 to assist with establishing or changing the operating state of ice making assembly 160 at step 230.

Method 200 can also include ascertaining whether ice storage bin 164 is full. As an example, controller 190 can utilize a sensor, such as a feeler arm or an optical sensor, to measure or determine the level of ice nuggets within ice storage bin 164. If the ice storage bin 164 is full, control 190 deactivates or turns off motor 174 and fan 176 of ice making assembly 160, e.g., in order to stop production of ice nuggets by ice making assembly 160. Conversely, controller 190 can establish the operating state of ice making assembly 160 if the ice storage bin 164 is not full.

Figure 5:
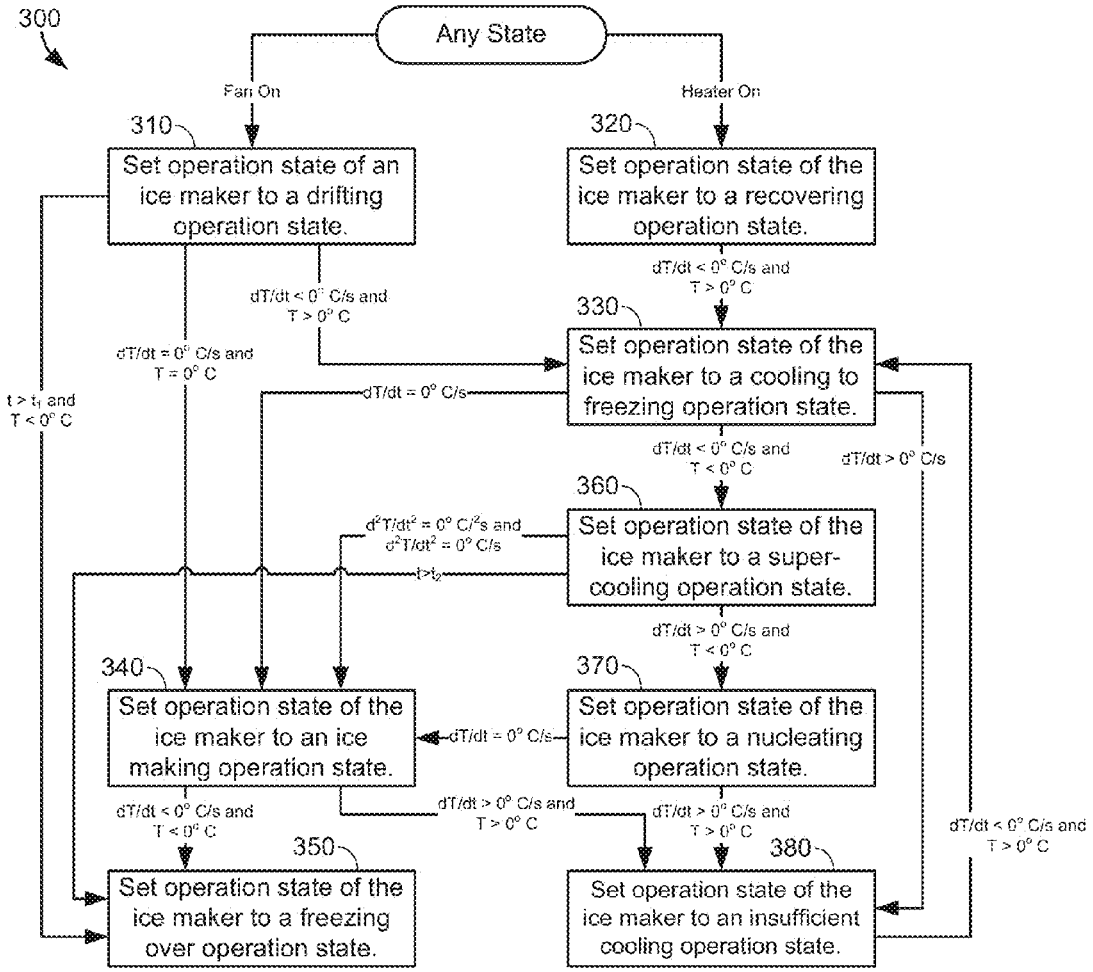
FIG. 5 illustrates a state transition graph according to an exemplary embodiment of the present subject matter.
Figure 6:
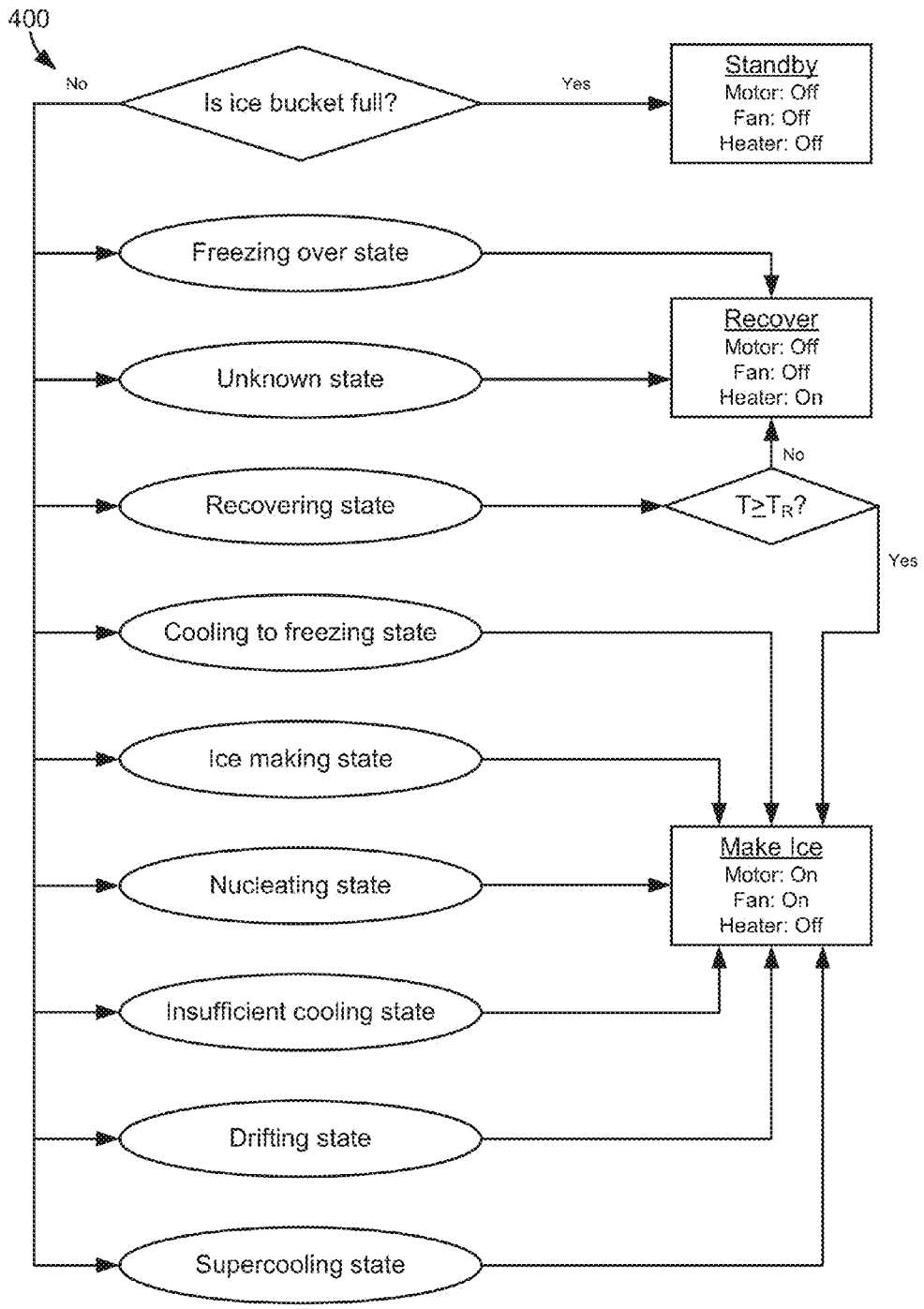
FIG. 6 illustrates a command flow chart according to an exemplary embodiment of the present subject matter.

FIG. 5 illustrates a state transition graph 300 according to an exemplary embodiment of the present subject matter. FIG. 6 illustrates a command flow chart 400 according to an exemplary embodiment of the present subject matter. Controller 190 can utilize state transition graph 300 and/or command flow chart 400 to establish the operating state of ice making assembly 160 at step 230 and operate ice making assembly 160 according to the established operating state.

As may be seen in FIG. 5, the operating state of ice making assembly 160 can be any of a plurality of operating states. In particular, the operating states of ice making assembly 160 include a drifting state at step 310, a recovering state at step 320, a cooling to freezing state at step 330, an ice making state at step 340, a freezing over state at step 350, a supercooling state at step 360, a nucleating state 370 and an insufficient cooling state at step 380. At step 230, controller 190 can establish the operating state of ice making assembly 160 as any of the ice making state, the freezing over state, the insufficient cooling state, the nucleating state, the cooling to freezing state, the supercooling state, the drifting state or the recovering state, e.g., according to the state transition graph 300 shown in FIG. 5.

When ice making assembly 160 is activated or an ice making cycle of ice making assembly 160 is initiated, controller 190 establishes the operating state of ice making assembly 160 as the drifting state or the recovering state. Controller 190 establishes the operating state of ice making assembly 160 as the drifting state if fan 176 is on or activated. Conversely, controller 190 establishes the operating state of ice making assembly 160 as the recovering state if heater 180 is on or activated.

As may be seen in FIG. 5, if the operating state of ice making assembly 160 is the drifting state (at step 310), controller 190 changes the operating state of ice making assembly 160 from the drifting state to the freezing over state if the temperature of casing 170 is less than about zero degrees Celsius at step 210 and an elapsed time that ice making assembly 160 has been in the drifting state is greater than a first predetermined time interval. Conversely, controller 190 adjusts ice making assembly 160 from the drifting state to the ice making state if the temperature of casing 170 is about equal to zero degrees Celsius at step 210 and the first derivative of the temperature of casing 170 with respect to time is about equal to zero degrees Celsius per second at step 220. On the other hand, controller 190 shifts the operating state of the ice making assembly 160 from the drifting state to the cooling to freezing state if the temperature of casing 170 is greater than about zero degrees Celsius at step 210 and the first derivative of the temperature of casing 170 with respect to time is less than about zero degrees Celsius per second at step 220.

If the operating state of ice making assembly 160 is the recovering state (at step 320), controller 190 changes the operating state of ice making assembly 160 from the recovering state to the cooling to freezing state if the temperature of casing 170 is greater than about zero degrees Celsius at step 210 and the first derivative of the temperature of casing 170 with respect to time is less than about zero degrees Celsius per second at step 220.

If the operating state of ice making assembly 160 is the cooling to freezing state (at step 330), controller 190 changes the operating state of ice making assembly 160 from the cooling to freezing state to the ice making state if the first derivative of the temperature of casing 170 with respect to time is about zero degrees Celsius per second at step 220. Conversely, controller 190 shifts the operating state of the ice making assembly 160 from the cooling to freezing state to the super-cooling state if the temperature of casing 170 is less than about zero degrees Celsius at step 210 and the first derivative of the temperature of casing 170 with respect to time is less than about zero degrees Celsius per second at step 220. On the other hand, controller 190 changes the operating state of ice making assembly 160 from the cooling to freezing state to the insufficient cooling state if the first derivative of the temperature of casing 170 with respect to time is greater than about zero degrees Celsius per second at step 220.

If the operating state of ice making assembly 160 is the ice making state (at step 340), controller 190 changes the operating state of ice making assembly 160 from the ice making state to the freezing over state if the temperature of casing 170 is less than about zero degrees Celsius at step 210 and the first derivative of the temperature of casing 170 with respect to time is less than about zero degrees Celsius per second at step 220. Conversely, controller 190 changes the operating state of ice making assembly 160 from the ice making state to the insufficient cooling state if the temperature of casing 170 is greater than about zero degrees Celsius at step 210 and the first derivative of the temperature of casing 170 with respect to time is greater than about zero degrees Celsius per second at step 220.

If the operating state of ice making assembly 160 is the super-cooling state (at step 360), controller 190 changes the operating state of ice making assembly 160 from the super-cooling state to the nucleating state if the temperature of casing 170 is less than about zero degrees Celsius at step 210 and the first derivative of the temperature of casing 170 with respect to time is greater than about zero degrees Celsius per second at step 220. Conversely, controller 190 adjusts ice making assembly 160 from the super-cooling state to the freezing over state if the elapsed time that ice making assembly 160 has been in the super-cooling state is greater than a second predetermined time interval. On the other hand, controller 190 shifts the operating state of the ice making assembly 160 from the super-cooling state to the ice making state if the first derivative of the temperature of casing 170 with respect to time is about zero degrees Celsius per second at step 220 and the second derivative of the temperature of casing 170 with respect to time is about zero degrees Celsius per second squared.

If the operating state of ice making assembly 160 is the nucleating state (at step 370), controller 190 changes the operating state of ice making assembly 160 from the nucleating state to the ice making state if the first derivative of the temperature of casing 170 with respect to time is about zero degrees Celsius per second at step 220. Conversely, controller 190 changes the operating state of ice making assembly 160 from the nucleating state to the insufficient cooling state if the temperature of casing 170 is greater than about zero degrees Celsius at step 210 and the first derivative of the temperature of casing 170 with respect to time is greater than about zero degrees Celsius per second at step 220.

If the operating state of ice making assembly 160 is the insufficient cooling state (at step 380), controller 190 changes the operating state of ice making assembly 160 from the insufficient cooling state to the cooling to freezing state if the temperature of casing 170 is greater than about zero degrees Celsius at step 210 and the first derivative of the temperature of casing 170 with respect to time is less than about zero degrees Celsius per second at step 220.

Turning now to FIG. 6, controller 190 operates ice making assembly 160, e.g., motor 174, fan 176 and/or heater 180, according to the operating state of ice making assembly 160 established or changed at step 230. Controller 190 can operate ice making assembly 160 according to an operational profile associated with the operating state of ice making assembly 160 established or changed at step 230. The operational profiles of ice making assembly 160 can include a standby mode, a recover mode and a make ice mode. In the standby mode, motor 174, fan 176 and heater 180 of ice making assembly 160 are deactivated. Controller 190 can operate ice making assembly 160 in the standby mode when ice storage bin 164 is full.

In the recover mode, controller 190 operates or turns on heater 180. Motor 174 and fan 176 are deactivated or turned off in the recover mode, e.g., such that ice making assembly 160 is not generating or producing ice nuggets. With heater 180 active, heater 180 can melt ice in casing 170, e.g., in order to prevent or limit jamming of auger 172 in casing 170. Controller 190 operates ice making assembly 160 in the recover mode when the operating state of ice making assembly 160 is unknown, the freezing over state or the recovering state (e.g., if the temperature of casing 170 is not greater than a predetermined recovery temperature).

In the make ice mode, controller 190 operates or turns on motor 174 and fan 176. Heater 180 is deactivated or turned off in the make ice mode, e.g., such that ice making assembly 160 generates or produces ice nuggets. With motor 174 and fan 176 active, chilled air from fan 176 can cooling casing 170 and auger 172 can scrape ice from the inner surface of casing 170. Controller 190 operates ice making assembly 160 in the make ice mode when the operating state of ice making assembly 160 is the cooling to freezing state, the ice making state, the nucleating state, the insufficient cooling state, the drifting state, the super-cooling state or the recovering state (e.g., if the temperature of casing 170 is greater than or equal to the predetermined recovery temperature).

Figure 7:
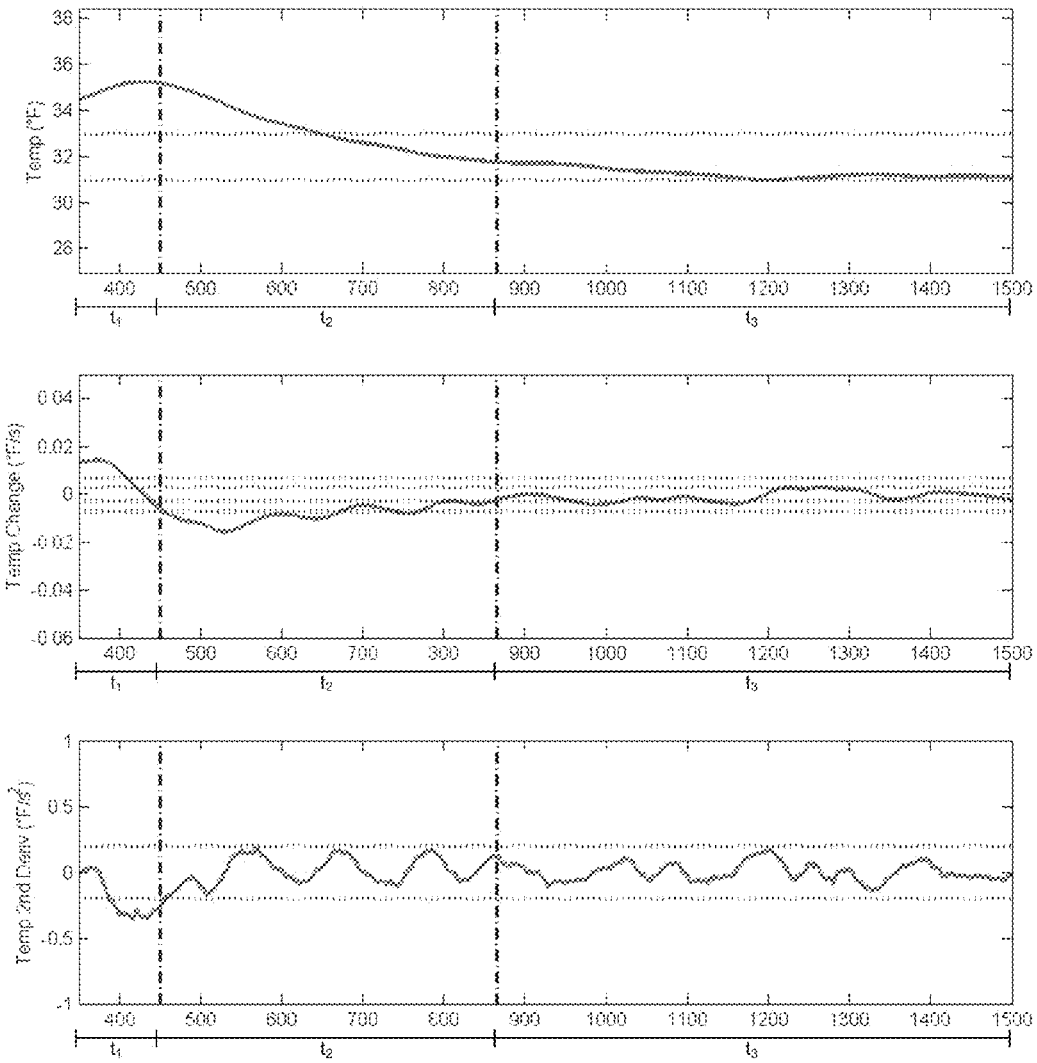
FIGS. 7, 8 and 9 provide graphs of a temperature, a first derivative of the temperature with respect to time and a second derivative of the temperature with respect to time for various operation cycles of an ice maker.
Figure 8:
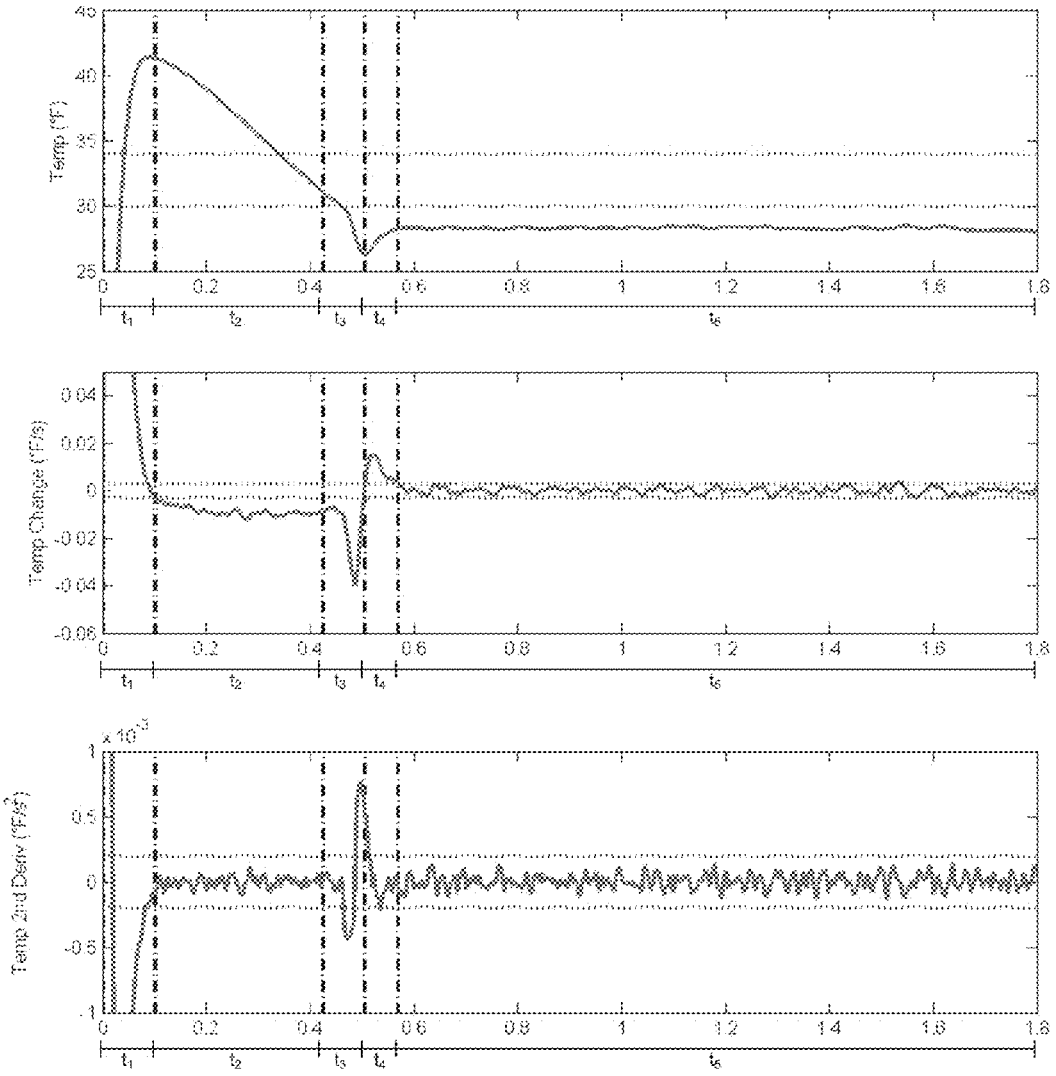
Figure 9:
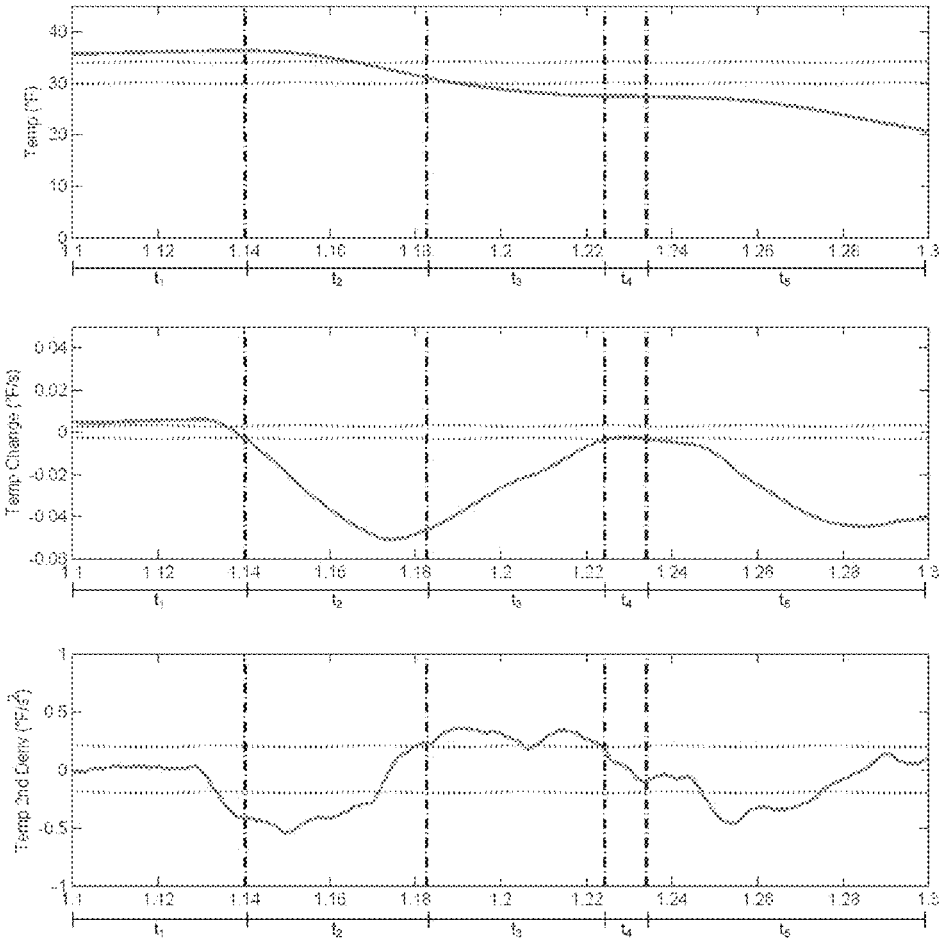

FIGS. 7, 8 and 9 provide graphs of the temperature, the first derivative of the temperature with respect to time and the second derivative of the temperature with respect to time of casing 170 for various operation cycles of ice making assembly 160. FIGS. 7, 8 and 9 illustrate operation of ice making assembly 160 according to method 200. Thus, the operating state of ice making assembly 160 can be established utilizing method 200, e.g., and the temperature, the first derivative of the temperature with respect to time and the second derivative of the temperature with respect to time of casing 170.

In FIG. 7, a normal operation cycle of ice making assembly 160 is shown. Ice making assembly 160 is in the drifting state for a first portion, $t_1$, of the normal operation cycle. During a second portion, $t_2$, of the normal operation cycle, the temperature of casing 170 is greater than zero degrees Celsius, but the temperature of casing 170 is decreasing such that the first derivative of the temperature of casing 170 with respect to time is negative during the second portion $t_2$ of the normal operation cycle. Thus, the operation state of ice making assembly 160 is the cooling to freezing state during the second portion $t_2$ of the normal operation cycle. Conversely, the temperature of casing 170 is less than zero degrees Celsius during a third portion, $t_3$, of the normal operation cycle, and the temperature of casing 170 is stable such that the first derivative of the temperature of casing 170 with respect to time is about zero degrees Celsius per second during the third portion $t_3$ of the normal operation cycle. Thus, the operation state of ice making assembly 160 is the ice making state during the third portion $t_3$ of the normal operation cycle.

In FIG. 8, a super-cooling operation cycle of ice making assembly 160 is shown. Ice making assembly 160 is in the drifting state for a first portion, $t_1$, of the super-cooling operation cycle. During a second portion, $t_2$, of the super-cooling operation cycle, the temperature of casing 170 is greater than zero degrees Celsius, but the temperature of casing 170 is decreasing such that the first derivative of the temperature of casing 170 with respect to time is negative during the second portion $t_2$ of the super-cooling operation cycle. Thus, the operation state of ice making assembly 160 is the cooling to freezing state during the second portion $t_2$ of the super-cooling operation cycle. Similarly, the temperature of casing 170 is less than zero degrees Celsius during a third portion, $t_3$, of the super-cooling operation cycle, and the temperature of casing 170 is decreasing such that the first derivative of the temperature of casing 170 with respect to time is negative during the third portion $t_3$ of the super-cooling operation cycle. Thus, the operation state of ice making assembly 160 is the super-cooling state during the third portion $t_3$ of the super-cooling operation cycle.

During a fourth portion, $t_4$, of the super-cooling operation cycle, the temperature of casing 170 is less than zero degrees Celsius, but the temperature of casing 170 is increasing such that the first derivative of the temperature of casing 170 with respect to time is positive during the fourth portion $t_4$ of the super-cooling operation cycle. Thus, the operation state of ice making assembly 160 is the nucleating state during the fourth portion $t_4$ of the super-cooling operation cycle. Similarly, the temperature of casing 170 is less than zero degrees Celsius during a fifth portion, $t_5$, of the super-cooling operation cycle, and the temperature of casing 170 is stable such that the first derivative of the temperature of casing 170 with respect to time is about zero degrees Celsius per second during the fifth portion $t_5$ of the super-cooling operation cycle. Thus, the operation state of ice making assembly 160 is the ice making state during the fifth portion $t_5$ of the super-cooling operation cycle.

In FIG. 9, a freezing over operation cycle of ice making assembly 160 is shown. Ice making assembly 160 is in the recovering state for a first portion, $t_1$, of the freezing over operation cycle. During a second portion, $t_2$, of the freezing over operation cycle, the temperature of casing 170 is greater than zero degrees Celsius, but the temperature of casing 170 is decreasing such that the first derivative of the temperature of casing 170 with respect to time is negative during the second portion $t_2$ of the freezing over operation cycle. Thus, the operation state of ice making assembly 160 is the cooling to freezing state during the second portion $t_2$ of the freezing over operation cycle. Similarly, the temperature of casing 170 is less than zero degrees Celsius during a third portion, $t_3$, of the freezing over operation cycle, and the temperature of casing 170 is decreasing such that the first derivative of the temperature of casing 170 with respect to time is negative during the third portion $t_3$ of the freezing over operation cycle. Thus, the operation state of ice making assembly 160 is the super-cooling state during the third portion $t_3$ of the freezing over operation cycle.

During a fourth portion, $t_4$, of the freezing over operation cycle, the first derivative of the temperature of casing 170 with respect to time is about zero degrees Celsius per second, and the second derivative of the temperature of casing 170 with respect to time is also about zero degrees Celsius per second squared during the fourth portion $t_4$ of the freezing over operation cycle. Thus, the operation state of ice making assembly 160 is the ice making state during the fourth portion $t_4$ of the freezing over operation cycle. Conversely, the temperature of casing 170 is less than zero degrees Celsius during a fifth portion, $t_5$, of the freezing over operation cycle, and the temperature of casing 170 is decreasing such that the first derivative of the temperature of casing 170 with respect to time is negative during the fifth portion $t_5$ of the freezing over operation cycle. Thus, the operation state of ice making assembly 160 is the freezing over state during the fifth portion $t_5$ of the freezing over operation cycle.

As may be seen in FIGS. 7, 8 and 9, method 200 may be used to determine the operation state of ice making assembly 160, e.g., utilizing the temperature of ice making assembly 160 measured at step 210 and the first derivative of the temperature of ice making assembly 160 with respect to time determined at step 220. Knowledge of the operating state of ice making assembly 160 can assist with preventing damage to motor 174 and/or with detecting super-cooled liquid water in casing 170. For example, ice making assembly 160 can continue to make ice in the super-cooling state while ice making assembly 160 can be deactivated in the freezing over state. Thus, method 200 can assist with distinguishing between the when liquid water in casing 170 is super-cooled versus when liquid water in casing 170 is freezing over.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. An ice maker assembly for a refrigerator appliance, comprising:

a casing;

an auger rotatably mounted within the casing;

a motor mounted to the casing and configured for selectively rotating the auger within the casing such that the auger scrapes ice from an inner surface of the casing;

an extruder positioned at the casing to form ice nuggets with the ice from the inner surface of the casing;

a fan configured for directing a flow of chilled air towards the casing;

a heater mounted to the casing and configured for selectively heating the casing;

a temperature sensor configured for measuring a temperature of the casing;

an ice bucket configured for receiving ice from the casing; and a controller in operative communication with the motor, the fan, the heater and the temperature sensor, the controller configured for measuring the temperature of the casing with the temperature sensor;

determining a first derivative of the temperature of the casing with respect to time;

ascertaining a second derivative of the temperature of the ice maker with respect to time;

establishing an operating state of the ice maker assembly based at least in part on the temperature of the casing, the first derivative of the temperature of the casing with respect to time and the second derivative of the temperature of the ice maker with respect to time; and operating a motor of the ice maker, a fan of the ice maker, and a heater of the ice maker according to one of a plurality of operational profiles associated with the established operating state of the ice maker, wherein the plurality of operational profiles comprises a making ice operational profile and a recovering operational profile, the making ice operational profile of the ice maker comprises activating the motor and the fan of the ice maker and deactivating the heater of the ice maker, wherein the recovering operational profile of the ice maker comprises deactivating the motor and the fan of the ice maker and activating the heater of the ice maker, wherein establishing the operating state of the ice maker assembly comprises selecting the operating state from a plurality of operating states, the plurality of operating states comprising an ice making state, a freezing over state, a nucleating state, an insufficient cooling state, a cooling to freezing state and a super-cooling state, and wherein establishing the operating state of the ice maker assembly comprises changing the operating state of the ice maker assembly from a drifting state to the freezing over state if the measured temperature of the casing is less than zero degrees Celsius, adjusting the operating state of the ice maker assembly from the drifting state to the ice making state if the temperature of the casing is about equal to zero degrees Celsius at said step of measuring, and shifting the operating state of the ice maker assembly from the drifting state to the cooling to freezing state if the measured temperature of the casing is greater than zero degrees Celsius.

2. The ice maker assembly of claim 1, wherein adjusting the operating state of the ice maker comprises adjusting the operating state of the ice maker assembly from the drifting state to the ice making state if the measured temperature of the casing is about equal to zero degrees Celsius and the determined first derivative of the temperature of the casing with respect to time is equal to zero degrees Celsius per second, wherein shifting the operating state of the ice maker comprises shifting the operating state of the ice maker assembly from the drifting state to the cooling to freezing state if the measured temperature of the casing is greater than zero degrees Celsius and the determined first derivative of the temperature of the casing with respect to time is less than zero degrees Celsius per second.

3. The ice maker assembly of claim 2, wherein said controller is further configured for:

operating the fan and the motor when the operating state of the ice maker assembly is the drifting state, the ice making state or the cooling to freezing state, the heater being deactivated while the motor of the ice maker is operating; and working the heater when the operating state of the ice maker assembly is the freezing over state, the fan and the motor being deactivated while the heater is working.

4. The ice maker assembly of claim 3, wherein establishing the operating state of the ice maker assembly comprises changing the operating state of the ice maker assembly from the cooling to freezing state to the super-cooling state if the measured temperature of the casing is less than zero degrees Celsius and the determined first derivative of the temperature of the casing with respect to time is less than zero degrees Celsius per second.

5. The ice maker assembly of claim 4, wherein said controller is further configured for operating the fan and the motor when the operating state of the ice maker assembly is the cooling to freezing state or the super-cooling state, the heater being deactivated while the fan and the motor are operating.

6. The ice maker assembly of claim 5, wherein establishing the operating state of the ice maker assembly comprises changing the operating state of the ice maker assembly from the super-cooling state to the ice making state if the determined first derivative of the temperature of the casing with respect to time is zero degrees Celsius per second and the ascertained second derivative of the temperature of the casing with respect to time is zero degrees Celsius per second squared.

7. The ice maker assembly of claim 6, wherein establishing the operating state of the ice maker assembly comprises:

changing the operating state of the ice maker assembly from the ice making state to the insufficient cooling state if the measured temperature of the casing is greater than zero degrees Celsius and the determined first derivative of the temperature of the casing with respect to time is greater than zero degrees Celsius per second; and adjusting the operating state of the ice maker assembly from the ice making state to the freezing over state if the measured temperature of the casing is less than zero degrees Celsius and the determined first derivative of the temperature of the casing with respect to time is less than zero degrees Celsius per second.

8. The ice maker assembly of claim 1, wherein said controller is further configured for:

operating the fan and the motor when the operating state of the ice maker assembly is the drifting state, the ice making state or the cooling to freezing state, the heater being deactivated while the motor of the ice maker is operating; and activating the heater when the operating state of the ice maker assembly is the freezing over state, the fan and the motor being deactivated while the heater is activated.

9. The ice maker assembly of claim 1, wherein establishing the operating state of the ice maker assembly comprises changing the operating state of the ice maker assembly from the cooling to freezing state to the super-cooling state if the measured temperature of the casing is less than zero degrees Celsius and the determined first derivative of the temperature of the casing with respect to time is less than zero degrees Celsius per second.

10. The ice maker assembly of claim 1, wherein said controller is further configured for operating the fan and the motor when the operating state of the ice maker assembly is the cooling to freezing state or the super-cooling state, the heater being deactivated while the fan and the motor are operating.

11. The ice maker assembly of claim 1, wherein establishing the operating state of the ice maker assembly comprises changing the operating state of the ice maker assembly from the super-cooling state to the ice making state if the determined first derivative of the temperature of the casing with respect to time is zero degrees Celsius per second and the ascertained second derivative of the temperature of the casing with respect to time is zero degrees Celsius per second squared.

12. The ice maker assembly of claim 1, wherein establishing the operating state of the ice maker assembly comprises:

changing the operating state of the ice maker assembly from the ice making state to the insufficient cooling state if the measured temperature of the casing is greater than zero degrees Celsius and the determined first derivative of the temperature of the casing with respect to time is greater than zero degrees Celsius per second; and adjusting the operating state of the ice maker assembly from the ice making state to the freezing over state if the measured temperature of the casing is less than zero degrees Celsius and the determined first derivative of the temperature of the casing with respect to time is less than zero degrees Celsius per second.

* * * * *